United States Patent [19]

Newcomb

[11] 4,367,773

[45] Jan. 11, 1983

[54] GUIDE FOR WITHDRAWING YARN FROM A FILLING MEASURING AND SUPPLYING DEVICE FOR A LOOM

[75] Inventor: Kermit T. Newcomb, South Hill, Va.

[73] Assignee: Burlington Industries, Inc., Greensboro, N.C.

[21] Appl. No.: 236,282

[22] Filed: Feb. 18, 1981

[51] Int. Cl.[3] ..... D03D 47/36

[52] U.S. Cl. ..... 139/452; 242/47.01

[58] Field of Search ..... 242/47.01, 47.04, 47.12, 242/47.13; 139/452, 435

[56] References Cited

U.S. PATENT DOCUMENTS

| | | | |
|---|---|---|---|
| 3,761,031 | 9/1973 | Pfarrwaller | 139/452 |
| 3,982,568 | 9/1976 | Riha | 139/452 |
| 4,156,441 | 5/1979 | Peter | 139/452 |

FOREIGN PATENT DOCUMENTS

| | | | |
|---|---|---|---|
| 2839437 | 8/1979 | Fed. Rep. of Germany | 139/452 |

*Primary Examiner*—Henry Jaudon
*Assistant Examiner*—Steven N. Meyers
*Attorney, Agent, or Firm*—Cushman, Darby & Cushman

[57] ABSTRACT

An improved guide for filling yarn in its travel to an inserting device for a loom from a yarn measuring and supplying device having a circular rotatable yarn winder provided with a circular array of yarn-catching fingers along a peripheral edge thereof. The guide comprises two concentric axially-spaced rings, one large and one small, with the larger adjustably mounted coaxially with but spaced from the fingers and having an inner diameter slightly smaller than the outer diameter of the winder edge. The smaller ring is spaced from the larger on the side opposite the winder to reduce ballooning of the withdrawn yarn.

2 Claims, 5 Drawing Figures

GUIDE FOR WITHDRAWING YARN FROM A FILLING MEASURING AND SUPPLYING DEVICE FOR A LOOM

FIELD OF THE INVENTION

This invention relates to shuttleless looms and, more especially, to looms wherein the filling yarn is inserted by an air jet. In greater particularity, the invention relates to an improved guide for the filling yarn in its travel from a yarn measuring and supplying device to the yarn inserting device.

BACKGROUND OF THE INVENTION

The yarn measuring and supplying device for a known type of air jet loom includes a rotatable yarn winding drum to which yarn is fed tangentially through a radial slot in a cylindrical drum cover from a suitable supply, e.g., a package, and from which yarn is withdrawn laterally or endwise from one end of the drum. Telescoped into that end of the drum is a short cylinder having along the corresponding end edge a circular array of yarn-catching fingers extending parallel to the cylinder axis. The cylinder is of slightly smaller diameter than the drum and is rotatable therewith but also is reciprocable on its axis to extend the fingers out of the drum into catching engagement with the withdrawn yarn end to wind yarn onto the drum, or retract the fingers at least partly into the drum to release the wound yarn for withdrawal from the corresponding end of the drum. Secured to the cylindrical drum cover over the fingers is a yarn guide end cover plate, somewhat concave on its inner side and having a central circular opening aligned with the axis of the drum. The inner side of the cover plate is formed with an annular groove or channel into which the circular array of fingers loosely fits when extended.

In operation of such a measuring and supplying device, the fingers are extended to catch the yarn, the drum and fingers rotated to wind a predetermined length of yarn onto the drum, rotation of the drum and fingers stopped, the fingers retracted to release the yarn withdrawal end, and the measured length withdrawn through the central opening in the end cover plate by the inserting device. The cycle is then repeated.

While such yarn measuring and supplying device is in use on looms presently in commercial operation, it possesses disadvantages. In particular, it has a strong tendency to break or otherwise damage yarn filaments, especially glass or fiberglass filaments, by the abrupt bends imposed therein in being pushed into the annular channel in the end cover plate. Moreover, unless the yarn-catching cylinder is carefully fitted and adjusted, with relation to the end cover plate, and vice-versa, the yarn-catching fingers engage and rub against the end cover plate with resulting damage to one or both. Moreover, considerable jump rope motion, or the phenomenon known as "ballooning", of the yarn occurs in its travel from the central hole in the end cover plate to the inserting device, which may be an air jet nozzle. Such ballooning not only tends to damage the yarn but also to wear excessively the yarn entrance of the inserting device. Further, the end cover plate is relatively expensive.

U.S. patents relating to somewhat comparable yarn measuring and supplying devices are:

Bucher, U.S. Pat. No. 3,276,484, Oct. 4, 1966

Bucher, U.S. Pat. No. 3,411,547, Nov. 19, 1968
Hosono et al, U.S. Pat. No. 3,674,057, July 4, 1972
Tannert, U.S. Pat. No. 3,709,444, Jan. 9, 1973
Rosen, U.S. Pat. No. 3,904,141, Sept. 9, 1975

The devices disclosed in these patents, however, possess one or more of the disadvantages described above, and especially tend to cut or break glass yarn filaments.

SUMMARY OF THE INVENTION

Accordingly it is an object of this invention to provide an improved yarn withdrawal guide for a yarn measuring and supplying device of the type described above which takes the place of, but is less expensive than, the end cover plate, which minimizes damage to or breakage of yarn filaments, especially glass yarn, and which reduces ballooning of the yarn in its travel from the measuring device to the inserting device with consequent less wear on the yarn entrance of the latter.

The foregoing objects are accomplished by replacing the end cover plate with two yarn guide rings both concentric with the winding drum. One of the rings is larger than the other and is fixedly mounted adjacent but in spaced relation to the yarn-catching fingers when they are extended. This larger ring is of an inner diameter slightly smaller than the outer diameter of the circular array of the fingers. The other smaller ring is spaced outwardly of the other, along the line of travel of the yarn to the inserting device, to reduce ballooning of the yarn during such travel.

Other objects and advantages of the invention will become apparent from the following detailed description and accompanying drawings, in which:

DETAILED DESCRIPTION OF THE INVENTION

Figure 1:
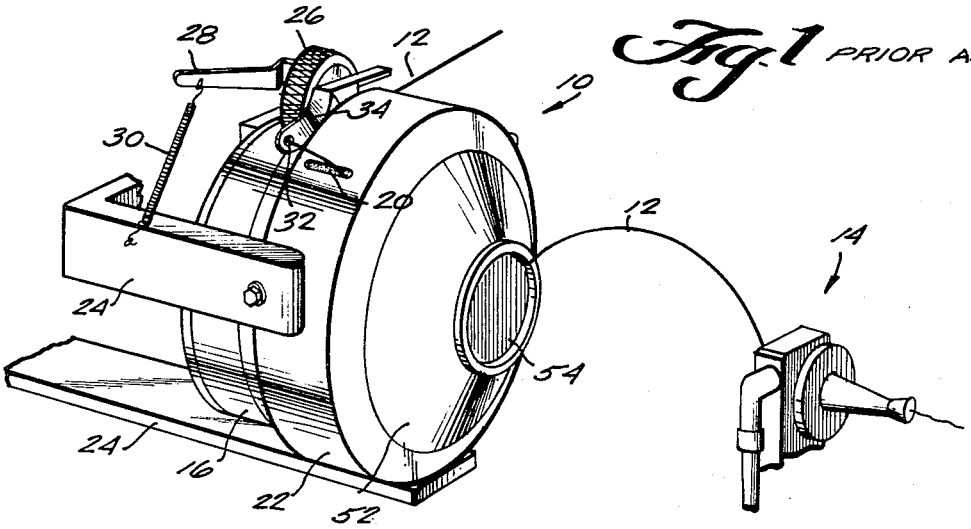
Fig. 1 PRIOR ART
FIG. 1 is a perspective view of a prior art filling yarn measuring and supplying device for the filling yarn inserting device of a loom.
Figure 2:
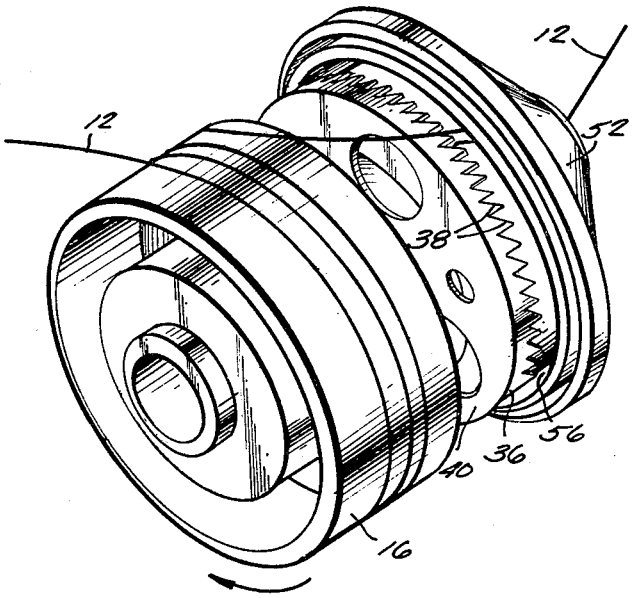
Fig. 2 PRIOR ART
FIG. 2 is an exploded perspective view of some of the parts of the device shown in FIG. 1.
Figure 3:
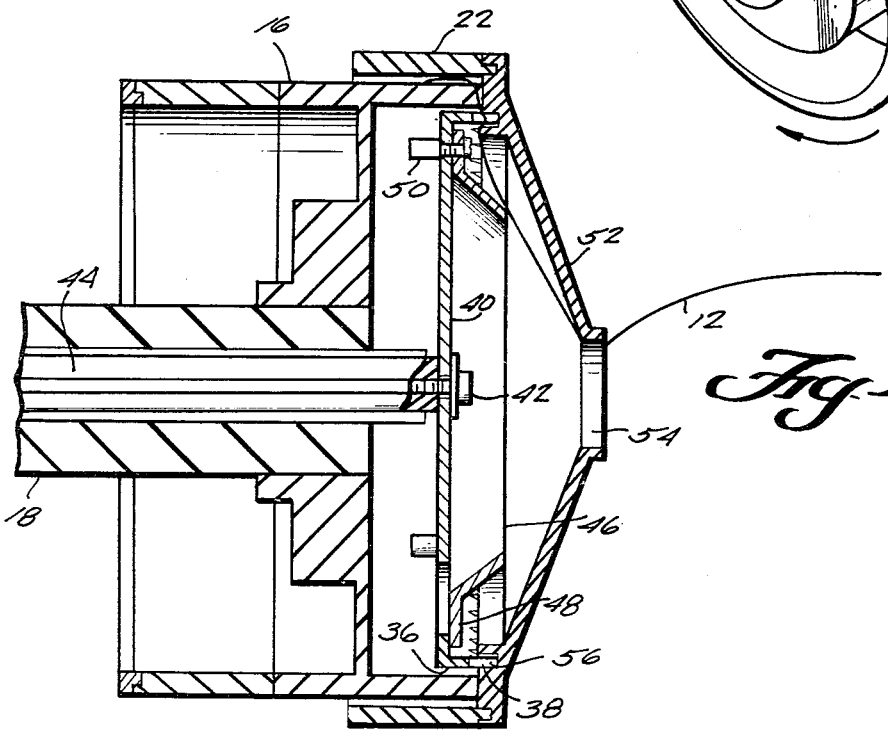
Fig. 3 PRIOR ART
FIG. 3 is a longitudinal sectional view of the measuring and supplying device shown in FIG. 1.

Referring now to FIGS. 1 and 2 of the drawings, there is shown a prior art device 10 for measuring and supplying predetermined lengths of filling yarn 12 to a filling yarn inserting device, e.g., an air jet nozzle 14, for a loom (not shown). The device includes a cylindrical winding drum 16 mounted on a drum winding shaft 18 driven by known means (not shown) in timed relation to the movements of the loom. Filling yarn 12 is supplied to the drum 16 tangentially through a slot 20 in a cylindrical drum cover 22. The cover 22, of less length than the drum 16, surrounds an end portion of the drum and is mounted to a fixed supporting structure (not shown) by bracket arms 24. Yarn 12 is fed to the measuring device 10 from a suitable supply, e.g., a package (not shown) through the nip between the uncovered surface of the drum 16 (at one side of the cover 22) and a yarn feed wheel 26 which rides on the drum 16. The wheel 26 is journalled on a stub shaft (not shown) carried by a feed wheel lever 28 urged by a spring 30 to hold the wheel 26 against the drum 16. From the nip, the yarn 12 is led through the eye 32 of a filling guide 34 to the slot 20.

Telescoped into the covered end of the drum 16 for reciprocation axially of the drum is a short cylinder 36 having a circumferential array of yarn catching teeth or fingers 38 projecting longitudinally from the outer end of the cylinder 36 parallel to its axis. One side edge of each tooth 38 is generally parallel to the axis of the cylinder 36, while the other is inclined rearwardly relative to the direction of rotation of the cylinder 36, as shown by the arrow in FIG. 2, which is rotatable with the drum 16. At its other end, the cylinder 36 is provided with an end plate 40 coaxially fastened, as by a screw 42, to the end of a rod 44 which extends through the shaft 18 and is rotatable therewith, such as being splined thereto. The rod 44 also in reciprocable within the shaft 18 to retract the fingers 38 partly within the drum 16 or extend them outwardly beyond the corresponding end of the drum into a position to catch yarn 12, as later described, so that rotation of the drum 16 and cylinder 36 will wind yarn from the slot 20 onto the drum 16. The rod 44 is reciprocated by known means (not shown) in timed relation to rotational movement of the drum 16. Preferably a conical cover plate 46 has a base flange, secured, as by screws 48, to the end plate 40 of the cylinder 36.

Detachably fastened to the cylindrical cover 22 over the corresponding ends of the drum 16 and the cylinder 36 is a frusto-conical yarn guide cover plate 52 having a central circular aperture 54. At this larger end, the plate 52 has an annular recess 56 which loosely receives the fingers 38, when extended.

In operation, yarn 12 is trained through the slot 20 in the cylinder cover 22 and out through the central aperture 54 in the yarn guide cover plate 52 to the inserting device 14. The latter cover plate 52 is detached from the cylindrical cover 22 to facilitate this maneuver and the replaced. When the loom is in operation, the rod 44 moves to extend the fingers 38 to catch the yarn 2 on the edge of a finger parallel to the drum axis, the drum 16 and cylinder 36 rotate a given amount to wind a predetermined length of yarn onto the drum 165, as shown in FIG. 2, the fingers 38 retract, and the inserting device 14 pulls the measured length of yarn laterally or endwise off of the drum 16 through the central aperture 54 in the yarn guide cover 52, the trailing end of the length of yarn being clamped between the feed wheel 26 and the drum 16.

During this sequence of operations, it will be seen that the yarn 12 traverses a tortuous path having abrupt bends therein, i.e., into and out of the annular recess 56 in the yarn guide cover plate 52. When the yarn 12 is of glass or fiber glass such bends cause broken filaments with resulting poor quality fabric. Moreover, the yarn 12 revolves about the circular edge of the aperture 54 in the yarn guide plate 52 as it exits through the aperture with a jump rope motion that causes the yarn to balloon unduly as it travels to the inserting device 12. Such undue ballooning has a damaging effect on yarn, especially glass yarn, as well as causing considerable wear on the yarn entrance of the inserting device 14.

Moreover, unless the yarn guide cover plate 52 is carefully constructed and installed, the fingers 38 tend to rub against the side walls and/or bottom of the annular recess 56 in the plate with resulting damage to both, even necessitating replacement upon occasion.

Figure 4:
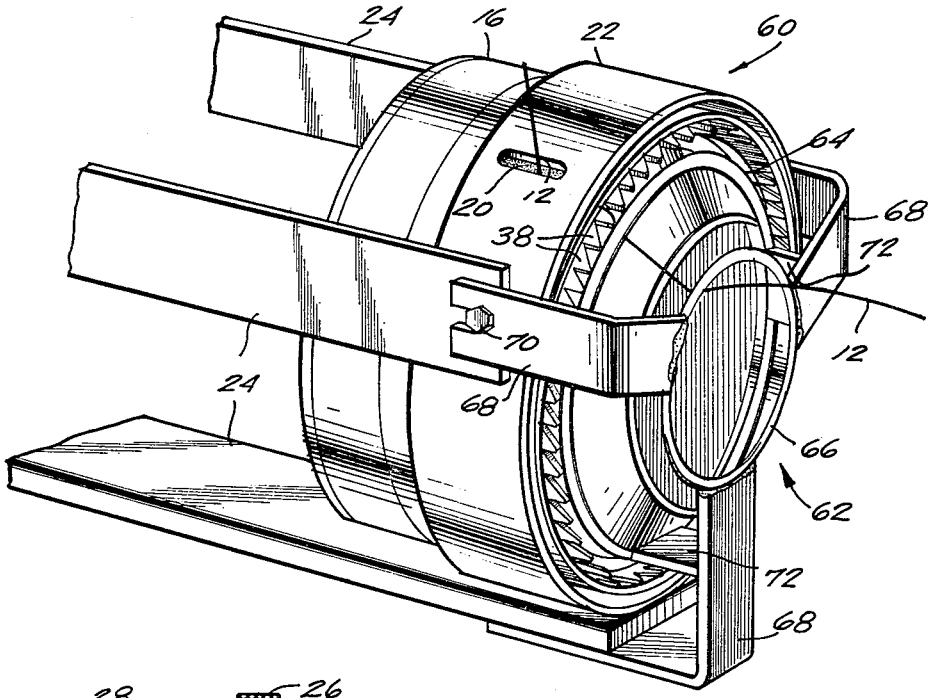
FIG. 4 is a perspective view of a filling yarn measuring and supplying device having a yarn withdrawal guide embodying this invention.
Figure 5:
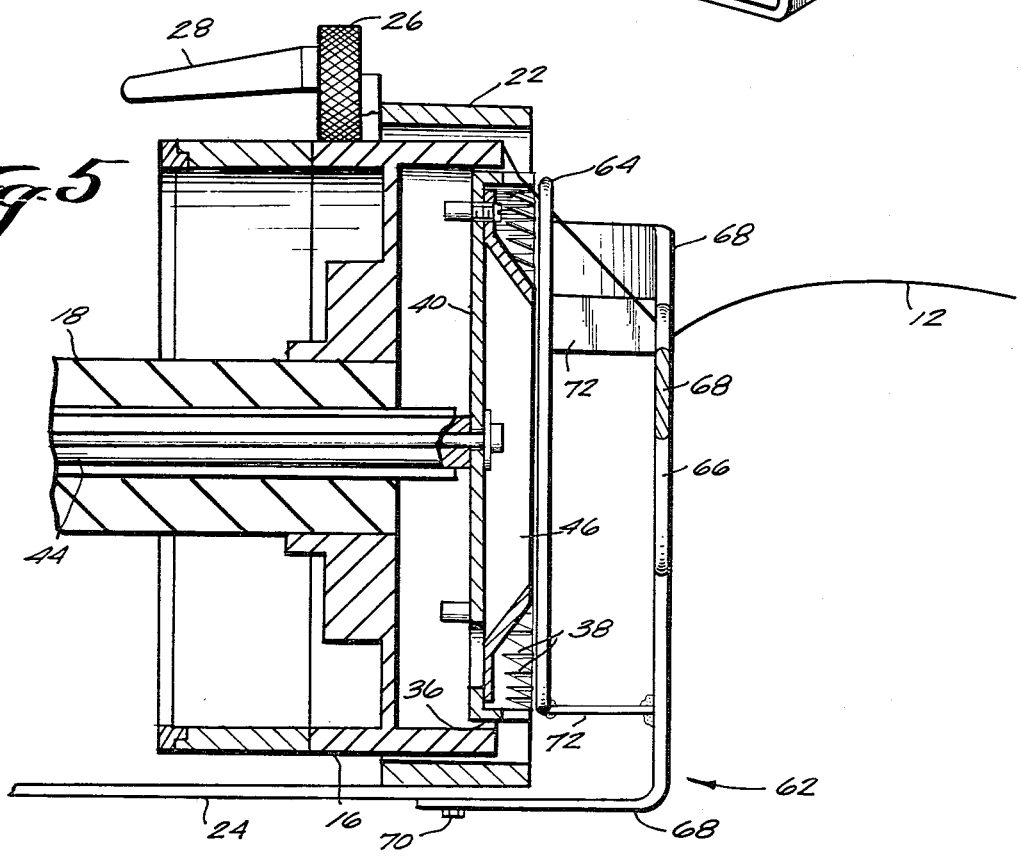
FIG. 5 is a longitudinal sectional view of the device shown in FIG. 4.

Referring now to FIGS. 4 and 5, there is shown a yarn measuring and supplying device 60 embodying this invention. All the elements or components of the device 60 are the same as those of the prior art device 10 except the yarn guide end cover plate 12 is eliminated. In its place is a yarn guide 62 in the form of two coaxial, axially-spaced rings, one large 64 and one small 66, mounted coaxially with the drum 16. The larger ring 64 is located closely adjacent the tips of the circular array of fingers 38, when extended, and has an inner diameter slightly less than the inner diameter of the circular array. The smaller ring 66 is spaced outwardly of the larger ring 64 and has an inner diameter considerably less than that of the larger ring. The outer ring 66 is secured, as by welding or brazing, to the inner ends of the inturned legs of a number of, e.g. three, L-shaped mounting brackets 68. The ends of the other legs of the brackets 68, which extend parallel to the drum axis, are slotted for the reception of screws 70, or the like, for adjustably mounting the brackets 68 on the brackets 24 which carry the cylindrical drum cover 22. The larger ring 64 is secured to the brackets 68 by arms 72 extending parallel to the axis of the ring 64 between the ring 64 and the inturned legs of the brackets 68. The arms 22 are secured to the ring 64 and the brackets 68, as by welding or brazing.

The operation of the device 60 is the same as that of the prior art device 10 except that the measured length of yarn is pulled endwise off of the drum 16 through the rings 64 and 66. It will be noted that the yarn 12 travels off the drum 16 to the larger ring 64 in a generally straight path with no tortuous bends, thus minimizing or eliminating yarn damage and broken filaments. Further, the adjustable mounting of the brackets 68 enables proper positioning of larger ring 64 adjacent but in spaced relation to the fingers 38 when extended with no possibility of engagement and rubbing of the ring 64 by the fingers, thus eliminating that source of damage to the fingers and the yarn guide 62.

The location of the smaller ring 66 nearer the inserting device 14 reduces ballooning of the yarn 12 in its travel between the ring 66 and the device 14, thus reducing both yarn damage and wear in the yarn entrance of the inserting device.

Lastly, the yarn guide 62, including both rings 64, 66 and the brackets 68 is less expensive to make than the yarn guide end cover plate 52 of the prior art.

It thus will be seen that the objects and advantages of this invention have been fully and effectively achieved. It will be realized, however, that the foregoing specific embodiment has been disclosed only for the purpose of illustrating the principles of this invention and is susceptible of modification without departing from such principles. Accordingly, the invention includes all embodiments encompassed within the spirit and scope of the following claims.

I claim:

1. In a loom having means for inserting predetermined lengths of filling yarn and means for measuring and supplying such yarn lengths to the inserting means including a rotatable circular yarn winder provided with a circular array of yarn-etching fingers along a peripheral edge thereof, the combination of a guide for yarn lengths withdrawn endwise from one end of the winder to direct the withdrawn yarn to the inserting means, comprising:

a first ring having an inner diameter slightly smaller than the outer diameter of the winder fixedly mounted concentrically therewith adjacent to but spaced from the fingers; and a second ring having an inner diameter less than that of said first ring fixedly mounted concentrically with said first ring in spaced relation with that side thereof opposite the winder;

said first ring cooperating with said fingers for enabling catching of yarn thereby for winding it on the winder and said second ring preventing undue ballooning of the yarn as it is withdrawn from the end of the winder and supplied to the inserting means.

2. The structure defined in claim 1 including bracet means supporting both rings, said bracket means having legs extending parallel to the axis of and in spaced relation to the winder, said legs having slots for adjustably screwing said bracket means to fixed structure to properly position the guide with respect to the winder.

* * * * *